US012220006B2

(12) United States Patent
Jordaan

(10) Patent No.: US 12,220,006 B2
(45) Date of Patent: Feb. 11, 2025

(54) WRAP SKIRT

(71) Applicant: Amer Sports Canada Inc., North Vancouver (CA)

(72) Inventor: Anna Elizabeth Jordaan, North Vancouver (CA)

(73) Assignee: Amer Sports Canada Inc., North Vancouver (CA)

( * ) Notice: Subject to any disclaimer, the term of this patent is extended or adjusted under 35 U.S.C. 154(b) by 0 days.

(21) Appl. No.: 17/556,016

(22) Filed: Dec. 20, 2021

(65) Prior Publication Data

US 2023/0189902 A1 Jun. 22, 2023

(51) Int. Cl.
*A41D 1/14* (2006.01)

(52) U.S. Cl.
CPC ..... *A41D 1/14* (2013.01)

(58) Field of Classification Search
CPC .. A41D 1/14; A41D 2200/10; A41D 2400/44; A41D 2300/22; A41F 9/00; A41F 9/007; A41F 9/025
USPC ..... 2/227
See application file for complete search history.

(56) References Cited

U.S. PATENT DOCUMENTS 1,530,504 A * 3/1925 Lenkowsky ..... A41D 1/14 2/211
2,105,787 A * 1/1938 Herpich ..... A41D 1/14 D6/593
2,233,136 A 2/1941 Larson et al.
2,453,051 A * 11/1948 Vacca ..... A41D 7/005 D2/738
3,091,772 A 6/1963 Larson et al.
3,793,645 A * 2/1974 Kadison ..... A41F 9/025 2/221
3,859,667 A * 1/1975 Roy ..... A41D 1/14 2/212
3,975,777 A * 8/1976 Roy ..... A41D 1/06 2/919
4,774,726 A * 10/1988 Garrett ..... A41D 1/22 2/919

(Continued)

FOREIGN PATENT DOCUMENTS

GB 2187634 9/1987

OTHER PUBLICATIONS

KR inventer, The Structure Of Skirt Provided By Jeans, Jan. 19, 2007, KR200435411 Y1 or KR20060025972U (Year: 2007).*

*Primary Examiner* — Jillian K Pierorazio
(74) *Attorney, Agent, or Firm* — Terence P. O'Bien; Todd A. Rathe

(57) ABSTRACT

A wrap skirt may include a skirt panel having a top waist portion, a first end and a second end, a first portion of a first connector coupled to the skirt panel proximate the top waist portion between the first end and the second end, a second portion of the first connector coupled to the skirt panel proximate the top waist portion proximate the first end, a first portion of a second connector coupled to the skirt panel proximate the top waist portion between the first and end the second, and a second portion of the second connector coupled to the skirt panel proximate the top waist portion proximate the second end. The first connector is configured to retain the top waist portion about a waistline of a person as an overlapping portion of the skirt panel is wrapped and subsequently retained in place by the second connector.

17 Claims, 6 Drawing Sheets

(56) References Cited

U.S. PATENT DOCUMENTS

| | | | | |
|---|---|---|---|---|
| 8,161,573 | B1 * | 4/2012 | Burns-Cox | A41D 13/1263 2/70 |
| 8,191,176 | B2 * | 6/2012 | Oomae | A41F 9/025 2/221 |
| 10,779,584 | B1 * | 9/2020 | Smith | A41D 1/14 |
| 2008/0313790 | A1 * | 12/2008 | Miller | A41F 9/025 2/338 |
| 2011/0185542 | A1 * | 8/2011 | Kingsbury | A44B 1/08 24/304 |
| 2013/0298311 | A1 * | 11/2013 | Gerenda | A41F 9/025 24/68 E |
| 2014/0115755 | A1 * | 5/2014 | Mahar | A41F 9/025 2/336 |
| 2014/0215690 | A1 * | 8/2014 | Caulfield | A41F 17/00 2/227 |
| 2016/0021943 | A1 * | 1/2016 | Das | A41D 1/14 2/219 |
| 2016/0165974 | A1 * | 6/2016 | Peterson | A41D 15/00 2/70 |
| 2019/0014832 | A1 * | 1/2019 | Das | A41F 9/02 |
| 2021/0345692 | A1 * | 11/2021 | Xu | A41D 1/06 |

* cited by examiner

WRAP SKIRT

BACKGROUND

Wrap skirts, sometimes also referred to as draped skirts, are formed by a panel that wraps around a person's waist and that partially overlaps itself. Wrap skirts may be formed from a variety of different fabrics or other materials and may have a variety of different vertical lengths, a variety of different shapes and a variety of different degrees of overlapping.

Figure 1:
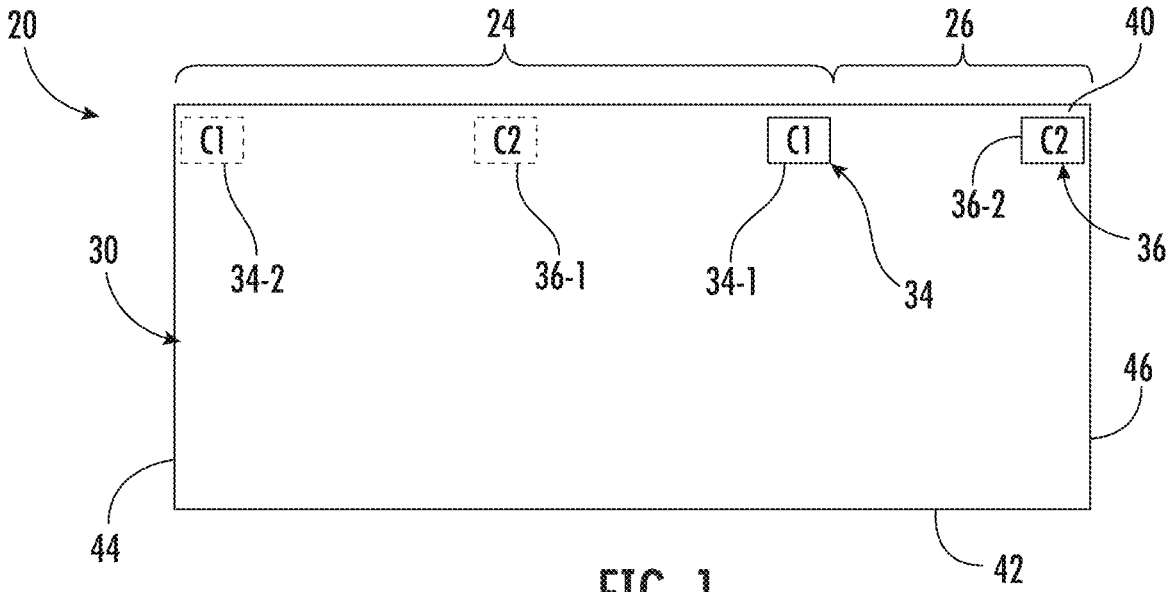
FIG. 1 is a diagram illustrating portions of an example wrap skirt.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example wrap skirts that facilitate easier wrapping and donning of the wrap skirt by person. The example wrap skirts comprise a waist portion which is to wrap about a person's waist and be in direct contact with the person's waist and an overlapping portion that it overlaps the waist portion. The example wrap skirts facilitate independent support of the waist portion prior to securement of the overlapping portion in an overlapping state. As a result, a person may more easily put on the wrap skirt.

Disclosed is an example wrap skirt that comprises a skirt panel having a top waist portion, a first end and a second end, a first portion of a first connector coupled to the skirt panel proximate the top waist portion between the first end and the second end, a second portion of the first connector coupled to the skirt panel proximate the top waist portion proximate the first end, a first portion of a second connector coupled to the skirt panel proximate the top waist portion between the first and end the second, and a second portion of the second connector coupled to the skirt panel proximate the top waist portion proximate the second end. The first connector is configured to retain the top waist portion about a waistline of a person as an overlapping portion of the skirt panel is wrapped and subsequently retained in place by the second connector.

In some implementations, the example wrap skirts provide waist length adjustability. In such implementations, the circumference of the waist portion is adjustable to different waist sizes. Upon being secured in place at a desired waist size, the overlapping portion may be secured in the overlapping state.

In some implementations, the example wrap skirts may additionally comprise a sleeve extending along the top waist portion and a webbing slidably positioned within the sleeve, wherein the first portion of the first connector is carried by a first end portion of the webbing and wherein the second portion of the second connector is carried by a second end portion of the webbing. In some implementations, the sleeve has a first opening on a first side of the skirt panel through which the first portion of the first connector extends and has a second opening on a second side of the skirt panel through which the second portion of the second connector extends. In some implementations, the wrap skirt may further comprise a flexible tether having a first end portion connected to the webbing and a second end portion anchored to the skirt panel.

In some implementations, the webbing comprises a catch carried by the webbing between the first portion of the first connector and a mouth of the sleeve, the catch being configured to inhibit movement of the first portion of the first connector into the sleeve. In some implementations, the catch comprises a hook to engage the mouth of the sleeve. In some implementations, the webbing is folded over itself and secured to itself to form the hook.

FIG. 1 is a diagram illustrating an example wrap skirt 20. Wrap skirt 20 comprises a waist portion 24 and an overlapping portion 26 that wraps over or overlaps the waist portion. Wrap skirt 20 may be easier to be put on in that waist portion 24 is configured to be supported about the waist of a person wearing wrap skirt 20 independent of and prior to securement of the overlapping portion 26 over top of the waist portion 24. As result, a person may first secure the waist portion 24 about his or her waist to ensure a proper fit without having to manage positioning of the overlapping portion 26. Once the waist portion 24 has been properly fit about the waist, the person may devote his or her attention to properly wrapping and securing the overlapping portion 26 over the already secured waist portion 24. Wrap skirt 20 comprises skirt panel 30, connector 34 and connector 36.

Skirt panel 30 comprises a continuous, integral sheet of material having a top waist portion 40, a lower edge 42, a first end 44 and a second end 46. One or more of the top waist portion 40, the lower edge 42, first end 44 and the second end 46 may include edge treatments. For example, one or more of the top waist portion 40, the lower edge 42, first end 44 and the second end 46 may include an additional stiffening strip of material, a hem, a fold, additional stitching and the like. Skirt panel 30 may be formed from a breathable fabric, a non-breathable fabric, a leather, a synthetic leather, a polymer or other materials. Although illustrated as being imperforate, uninterrupted and rectangular in shape, in some implementations, skirt panel 30 may have other shapes or may be perforated or interrupted in that skirt panel 30 may include slits, notches, openings or the like. Skirt panel 30 may include additional panels or attachments. For example, skirt panel 30 may include additional panels of material to form pockets or other complementary features.

Figure 2:
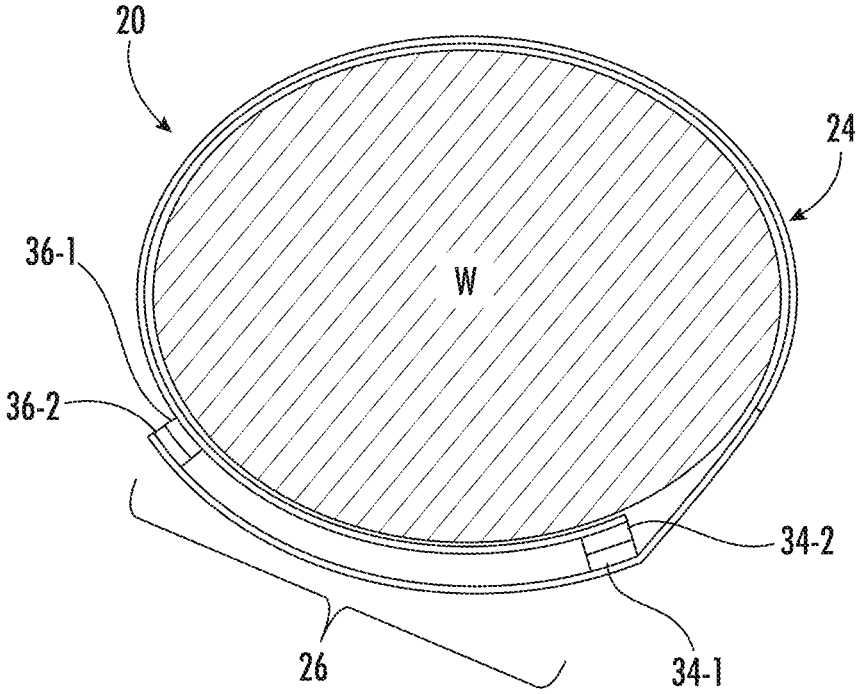
FIG. 2 is a diagram illustrating the example wrap skirt of FIG. 1 wrapped and secured about a waist of a person.

Connector 34 comprises a connection device secured to skirt panel 30 and configured to form waist portion 24. Connector 34 comprises a first connector portion 34-1 and second connector portion 34-2. First portion 34-1 is coupled to the skirt panel 30 proximate the top waist portion 40 between first and 44 and second end 46. Second connector portion 34-2 is coupled to the skirt panel proximate the top waist portion 40 proximate the first end 44. As shown by FIG. 2, first connector portion 34-1 connects to second connector portion 34-2 to retain waist portion 24 about the waist W of a person. Such retention occurs prior to the connection of connector 36.

Connector 36 comprise a connection device secured to skirt panel 30 and configured to retain overlapping portion 26 in place, over an outside of waist portion 24. Connector 36 comprises a first portion 36-1 and a second portion 36-2. First connector portion 36-1 is coupled to skirt panel 30 proximate top waist portion 40 between first end 44 and second end 46. First connector portion 36-1 is coupled skirt panel 30 between first connector portion 34-1 of connector 34 and second connector portion 34-2 of connector 36.

In the example illustrated, connector portions 34-1 and 36-2 are both coupled to skirt panel 30 on an inside or inner surface of skirt panel 30, the side of skirt panel 30 which is to face the waist and thighs of the person wearing wrap skirt 20. Connector portion 34-2 is coupled to skirt panel 30 on an exterior side of skirt panel 30, the side skirt panel 30 facing away from the waist and thighs of the person wearing wrap skirt 20. In other implementations, connector portions 34-1, 34-2, 36-1 and/or 36-2 may be coupled to skirt panel 30 on a face or side skirt panel 30 opposite to that shown, wherein portions of the skirt panel adjacent connector may be folded or bent to facilitate connection of the different connector portions.

In some implementations, connectors 34 and 36 may comprise cooperating portions of a hook and loop (VELCRO) connector. In some implementations, connectors 34 and 36 may comprise cooperating portions of a snap connector. In some implementations, connectors 34 and 36 may comprise cooperating portions of a quick disconnect buckle or other quick release connector. In yet other implementations, connectors 34 and 36 may comprise other forms of releasable or disengageable connectors, such as, for example, a button and a button hole. In some implementations, connector 34 may be of a first type of a connector while connector 36 is of a second different type of connector. For example, in some implementations, connector 34 may be a snap connector while connector 36 comprise a quick connect buckle connector.

Figure 3:
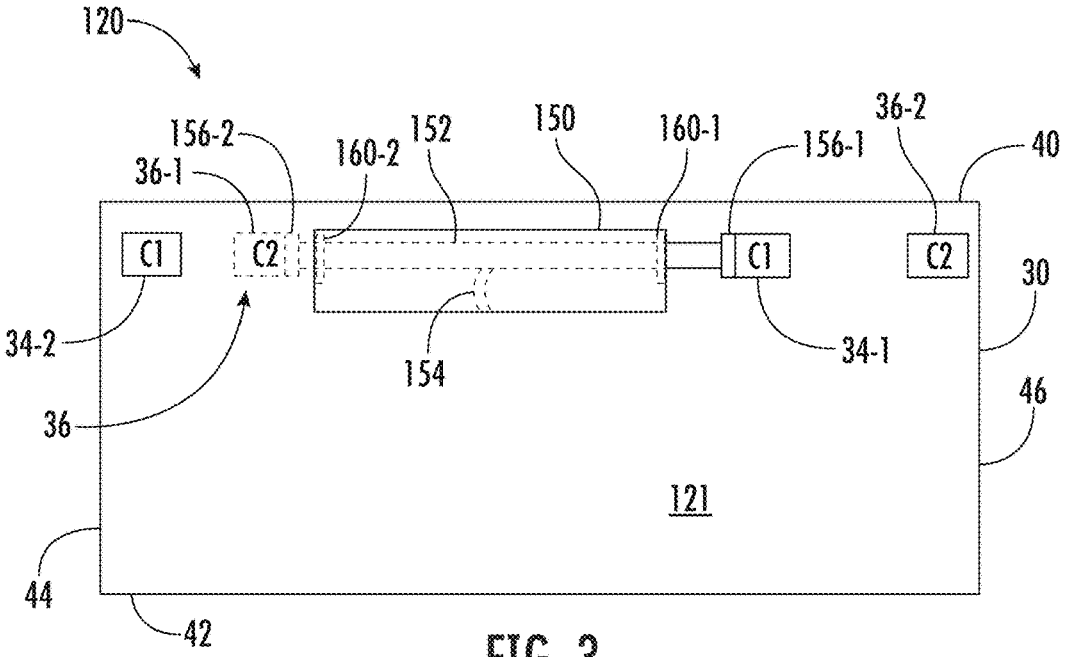
FIG. 3 is a diagram illustrating an inner face of an example wrap skirt.
Figure 4:
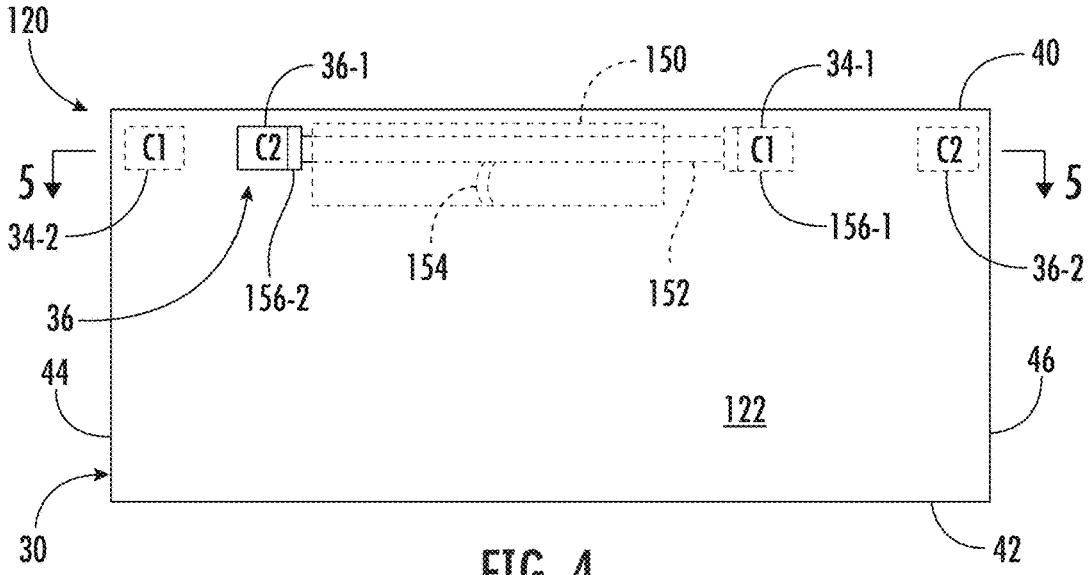
FIG. 4 is a diagram illustrating an exterior face of the example wrap skirt of FIG. 3.
Figure 5:
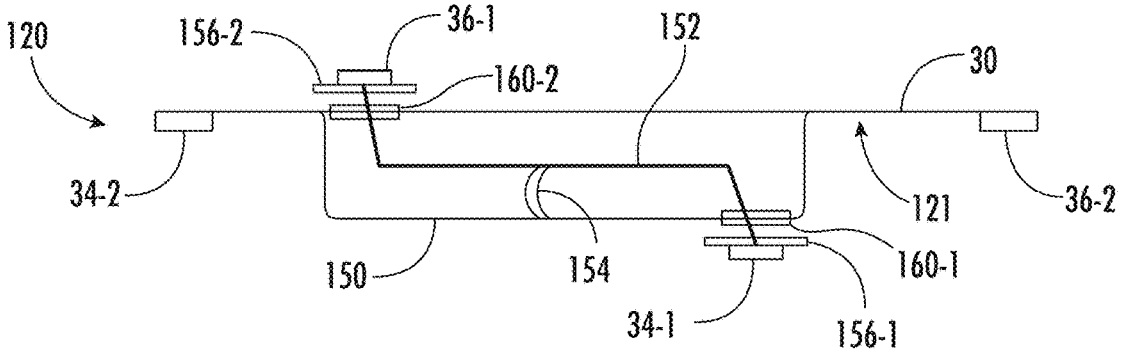
FIG. 5 is a sectional view of the example wrap skirt of FIG. 4 taken along line 5-5.

FIGS. 3-5 are diagrams illustrating an example wrap skirt 120. FIG. 3 illustrates an inner face 121 of wrap skirt 120, the face or side of wrap skirt 120 which is to face towards the waist and thighs of a person wearing wrap skirt 120. FIG. 4 illustrates an exterior face 122 of wrap skirt 120, the face or side of wrap skirt 120 which is to face away from the waist and thighs of a person wearing wrap skirt 120. FIG. 5 is a sectional view of wrap skirt 120 taken along line 5-5 of FIG. 4. Wrap skirt 120 is similar to wrap skirt 20 described above except that wrap skirt 120 additionally comprises sleeve 150, webbing 152, tether 154 and catches 156-1, 156-2 (collectively referred to as catches 156). Those remaining components of wrap skirt 120 which correspond to components of wrap skirt 20 are numbered similarly.

Sleeve 150 (greatly enlarged in FIG. 5 for purposes of illustration) retains and guides sliding movement of webbing 152. Sleeve 150 is coupled to skirt panel 30 on the inner face 121 of skirt panel 30 and is sized to slidably receive central portions of webbing 152. In the example illustrated, sleeve 150 has opposite axial ends spaced from ends 44 and 46

In the example illustrated, sleeve 150 is formed from a panel of material secured to the inner face 121 of skirt panel 30, wherein the inner face 121 of skirt panel 30 forms a portion of the interior surface of sleeve 150. In other implementations, sleeve 150 may comprise a tube or a pair of panels which completely form sleeve 150, wherein the sleeve is then coupled to inner face 121 of skirt panel 30. In some implementations, sleeve 150 may comprise multiple sections or multiple spaced loops formed on the inner face 122 of skirt panel 30 and through which portions of webbing 152 extend.

Sleeve 150 comprises openings 160-1 and 160-2 (collectively referred to as openings 160) through which webbing 152 extends. Openings 160 are located opposite axial ends of sleeve 150. In the example illustrated, opening 160-1 is located on the inner face 121 of skirt panel 30, opening towards the waist of a person wearing wrap skirt 120. Opening 160-2 extends through skirt panel 30, opening through the exterior face 122 of skirt panel 30, opening away from the waist of a person wearing wrap skirt 120.

In the example illustrated, sleeve 150 extends along a portion of top waist portion 40, having a length less than the length of top waist portion 40. In some implementations, sleeve 150 has a length no greater than 50% of the length of top waist portion 40. In the example illustrated, sleeve 150 has a length of at least 4 inches and no greater than 24 inches. In other implementations, sleeve 150 may extend along substantially the entire length of top waist portion 40, wherein openings 160 may be located at intermediate portions of the length of sleeve 150, extending through sides of sleeve 150 between its opposite axial ends. In some implementations, sleeve 150 may extend from one of ends 44, 46 and terminate at a location between ends 44 and 46.

Webbing 152 comprises a length of flexible material projecting from and through both of openings 160 of sleeve 150 and supporting connector portions 34-1 and 36-1 beyond openings 160. Webbing 152 is configured to bend and flex to conform to the waist of the person wearing wrap skirt 120. Webbing 152 is further configured to slide or move within and relative to the interior of sleeve 150.

In the example illustrated, webbing 152 comprises a flat strap of inelastic fabric material. In other implementations, webbing 152 may comprise a flexible cord having a circular or oval cross-section. In some implementations, webbing 152 may be formed from an elastic material. Webbing 152 may be formed from materials such as natural or synthetic fabrics, rubbers, synthetic rubbers, polymers and the like.

In the example illustrated, webbing 152 may slide along the length of sleeve 150 to permit both of connector portion 34-1 and 36-1 to be adjustably repositioned relative to ends 46 and 44, respectively. As a result, connector portion 34-1 and 36-1 may be more easily brought into connection with their respective complementary connector portions 34-2 and 36-2 when a person is dressing with wrap skirt 120. Because webbing 152 supports both of connector portions 34-1 and 36-1 at its opposite end portions, pulling one of connector portions 34-1, 36-1 further out of sleeve 150 shortens the extent to which the other of connector portions 34-1, 36-1 extends from sleeve 150. As a result, connector portion 34-1 may be extended when waist portion 24 is initially wrapped about a person's waist, allowing a looser initial fit of waist portion 40. Thereafter, connector portions 36-1 may be pulled for connection to connector portion 36-2 to secure overlapping portion 26 in its wrapped state while also concurrently tightening waist portion 24 about the person's waist.

Tether 154 comprises a flexible cord, strap or band of material having a first end portion connected to webbing 152 and a second end portion anchored, directly or indirectly, to skirt panel 30. In other implementations, a portion of the tether 154 can be connected to the skirt panel 30 and another portion, not necessarily the first end of the tether can be coupled to the webbing 152. Tether 154 may serve to limit the extent to which webbing 152 is pulled through opening 160-1 or alternatively through opening 160-2. Tether 154 allows some limited extent of movement of webbing 152 while preventing webbing 152 from being completely withdrawn from sleeve 150. In some implementations, tether 154 is inelastic. In other implementations, tether 154 has a controlled degree of elasticity or stretchability. In some implementations, the tether 154 has a length that is shorter than the length of the sleeve 150. In another implementation, the length of the tether 154 is no greater than half the length of the sleeve 150. In the example illustrated, tether 154 can have a length of at least 0.5 inch and no greater than 6 inches.

Catches 156 comprise structures configured to inhibit connector portions 34-1 and 36-1 from being moved or drawn into the interior of sleeve 150. In some implementations, catches 156-1, 156-2 comprise structures having a size greater than the size of openings 160-1 and 160-2, respectively. In some implementations, the connector portion 34-1 and/or connector portion 36-1 may concurrently serve as catches in that such connector portions may have a dimension greater than the size of the sleeve openings to inhibit such connector portions from being drawn into the interior of sleeve 150. In some implementations, catches 156 each comprise a hook to catch or engage the mouth of the associated opening 160-1, 160-2. In some implementations, catches 156-1, 156-2 comprise a portion of the webbing 152 folded over itself and secured to itself to form a fabric hook.

Figure 6:
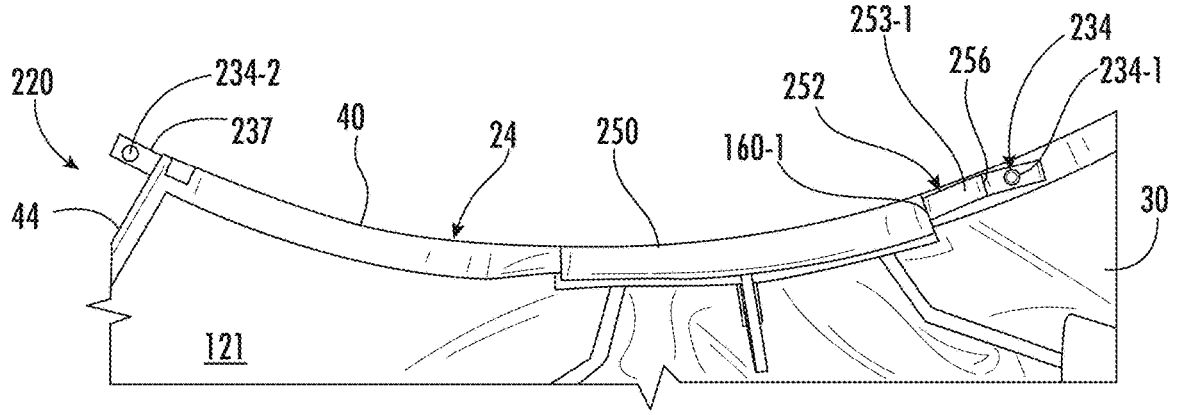
FIG. 6 is a perspective view of an inner face of an example wrap skirt.
Figure 7:
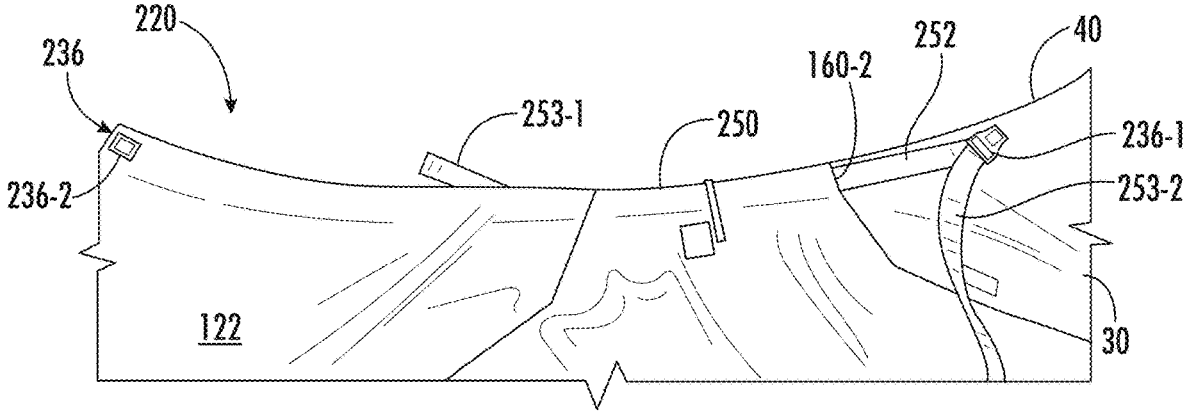
FIG. 7 is a perspective view of an exterior face of the example wrap skirt of FIG. 6.
Figure 8:
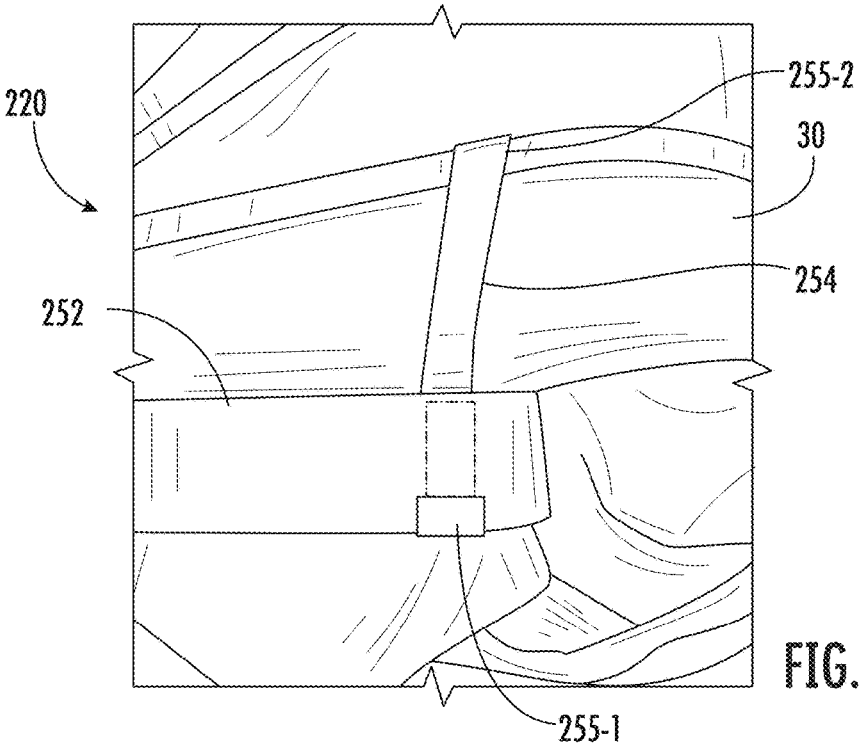
FIG. 8 is a perspective view of the example wrap skirt of FIG. 6 with forces removed illustrate an example webbing and anchor.

FIGS. 6-8 illustrate portions of an example wrap skirt 220. FIG. 6 is a perspective view of an inner side or face 121 of wrap skirt 220 in an extended state. FIG. 7 is a perspective view of an outer face or side 122 of wrap skirt 220 in the extended state. FIG. 8 illustrates portions of wrap skirt 220 broken away to illustrate interior contents of a sleeve of wrap skirt 220. Wrap skirt 220 is one example implementation of wrap skirt 120 described above. Wrap skirt 220 comprises skirt panel 30 (described above), connector 234, connector 236, sleeve 250, webbing 252, flexible tether 254 and catch 256.

Connector 234 is similar to connector 34 described above except that connector 234 particularly comprises a snap connector formed by snap connector portions 234-1 and 234-2. The region of top waist portion 40 extending between connector portion 234-1 and 234-2 forms the waist portion 24 of wrap skirt 220. In the example illustrated, connector portion 234-1 is supported on an end portion of strap 252 while connector portion 234-2 supported by a band 237 of material fixedly secured to and extending from end 44 of skirt panel 30. Band 237 facilitates easier manipulation of connector portion 234-2 when securing connector portion 234-2 to connector portion 234-1.

Connector 236 is similar to connector 36 described above except that connector 236 particularly comprises a quick release/quick connect buckle connector formed by connector portions 236-1 and 236-2. Connector portion 236-1 is slidably positioned and retained along webbing 252 while connector portion 236-2 is fixed to the outer face 122 of skirt panel 30. Connector portion 236-1 comprises a buckle through which webbing 252 extends, permitting the positioning of connector portion 236 along the length of webbing 252 to be adjusted. Connector portion 236-1 comprises a buckle portion that resiliently flexes and snaps into the corresponding quick release connector portion 236-2.

Sleeve 250 slidably supports and guides central portions of webbing 252 and is secured along top waist portion 40 of skirt panel 30. In the example illustrated, sleeve 250 is formed by a band of fabric stitched or otherwise secured to the inner face 121 of skirt panel 30, forming a passage through which webbing 252 extends. Sleeve 250 is generally centered at a center point between ends 44 and 46 shown in FIG. 11. In the example illustrated, sleeve 150 has a length of at least 4 inches and no greater than 24 inches.

Webbing 252 is similar to webbing 152 described above. In the example illustrated, webbing 252 comprise a band of flexible fabric, such as a flexible canvas material. As seen in FIG. 6, webbing 252 has a first end portion 253-1 projecting from opening 160-1 on the inner face of skirt panel 30, supporting connector portion 234-1 and catch 256. As seen in FIG. 7, webbing 252 has a second end portion 253-2 projecting from opening 160-2 on the exterior face 122 of skirt panel 30 and passing through connector portion 236-1.

As shown by FIG. 8, flexible tether 254 comprises a strap of material having a first end portion 255-1 affixed or connected to webbing 252 (such as by stitching) and a second end portion 255-2 affixed or anchored to skirt panel 30, either directly or indirectly via sleeve 250. As with flexible tether 54, flexible tether 254 limits an extent to which webbing 252 may be slid and pulled through either of openings 160 of sleeve 250. Tether 254 prevents webbing 252 from being completely withdrawn from sleeve 250. In the example illustrated, flexible tether 254 has a length of at least 0.5 inch and no greater than 6 inches. In some implementations, tether 254 may be omitted.

Figure 9:
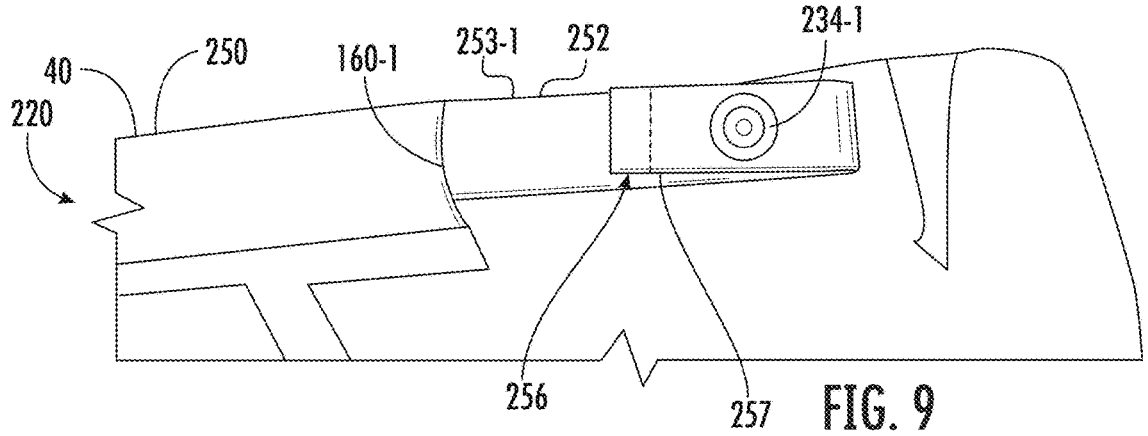
FIG. 9 is a perspective view of the example wrap skirt of FIG. 6 illustrating an example catch.
Figure 10:
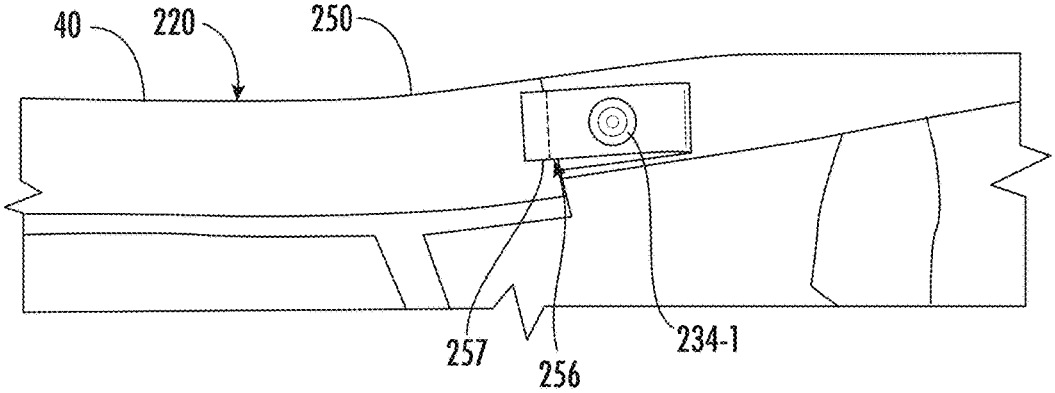
FIG. 10 is a perspective view of the example wrap skirt of FIG. 9 illustrating the catch engaging a mouth of an example sleeve.

Catch 256 (shown in FIG. 6) comprise a structure configured to inhibit connector portion 234-1 from being moved or drawn into the interior of sleeve 250. FIGS. 9 and 10 illustrate catch 256 in more detail. As shown by FIG. 9, in the example illustrated, catch 256 comprises a portion of the webbing 252 folded over itself and secured to itself (by stitching) to form a fabric hook 257. Connector portion 234-1 is secured on the folded overlapping portion of webbing 252. As shown by FIG. 9, the fabric hook 257 engages and catches upon the mouth of opening 160-1 to prevent connector portion 234-1 from being completely drawn into the interior of sleeve 250. In the example illustrated, the quick release buckle of connector portion 236-1 has a size greater than the size of opening 160-2 so as to serve as a catch.

Figure 11:
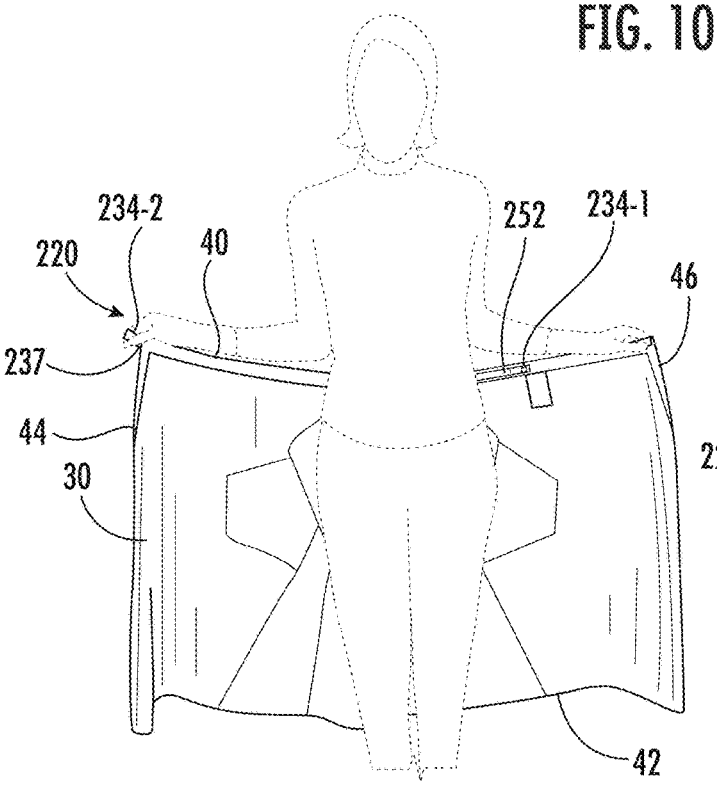
FIGS. 11 through 16 are perspective views illustrating a person donning the example wrap skirt of FIG. 6.

FIGS. 11-16 illustrate a person donning wrap skirt 220. FIG. 11 illustrates wrap skirt 220 being held behind the person's waist in an open and extended state. In the example illustrated, the person generally centers the sleeve 250 along his or her back with the connector portion 234-1 positioned along the left side of the person's waist. As shown by FIG. 11, the person may grasp band 237, keeping connector portion 23 4-2 exposed (not covered up by the fingers grasping end 44 of skirt panel 30) and ready for connection to connector portion 234-1.

Figure 12:
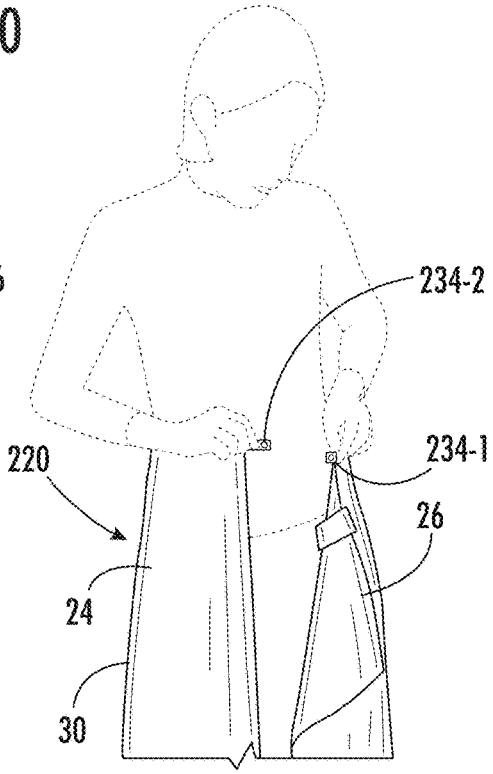

FIG. 12 illustrates the person wrapping end 44 to the right, across the front of the person's waist, moving connector portion 234-2 towards connector portion 234-1. During such connection, the person may rotate skirt panel 30 to better view connector portion 234-1 as connector portion 234-2 is brought into connection with connector portion 234-1. During such connection, connector portion 234-1 may be extended by pulling end portion 253-1 and strap 252 further out of sleeve 250 so as to temporarily loosen waist portion 24 for easier connection of connector 234.

Figure 13:
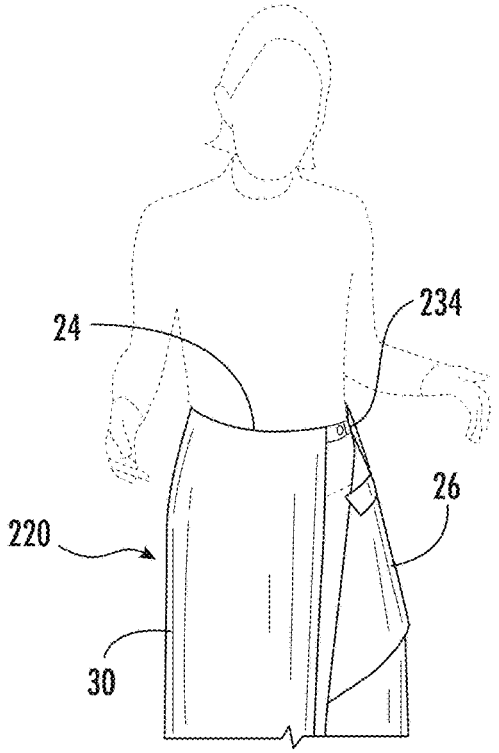

As shown by FIG. 13, once connector 234 has been connected, portion 234-1 and 234-2 have been snapped together, the person may rotate waist portion 24 about his or her waist to locate the beginning of overlapping portion 26 at a desired location, such as along the left side of the person wearing wrap skirt 220. As further shown by FIG. 13, once connector portion 234-1 and 234-2 have been connected to one another, waist portion 24 is fully supported about the person's waist prior to connection of connector 236, leaving overlapping portion 26 dangling and ready for subsequent connection. The securement of waist portion 24 about the person's waist may be performed without the need to concurrently grasp or otherwise manipulate overlapping portion 26. Once waist portion 24 has been secured, the person is ready to continue with the securement of overlapping portion 26 of wrap skirt 220.

Figure 14:
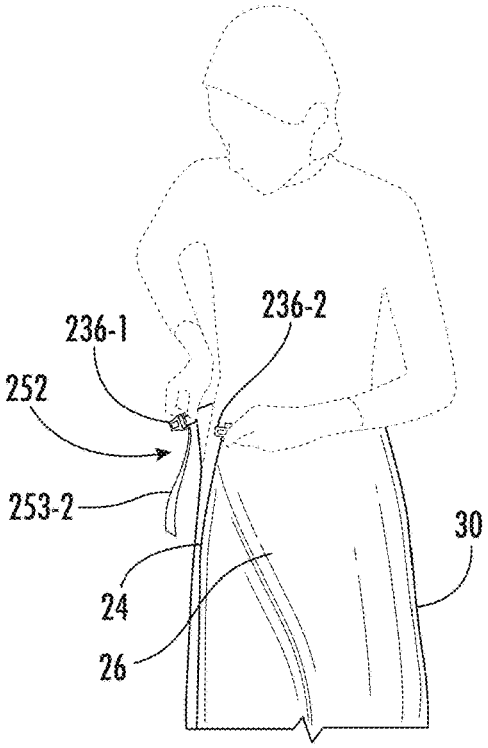

FIG. 14 illustrates the person subsequently grasping connector portion 236-1 and 236-2 (or nearby regions of wrap skirt 220) to initiate the securement of overlapping portion 26. FIG. 14 illustrates overlapping portion 26 being wrapped to the left, over waist portion 24 and across the front of the person wearing wrap skirt 220. FIG. 14 further illustrates connector portion 236-2 being grasped and being moved towards connector portion 236-1 which is supported on end portion 253-2 of strap 252. Because connector portion 236-1 is supported by strap 252, connector portion 236-1 may be more easily manipulated for interconnection with connector portion 236-2. During such connection, strap 252 may be pulled through the buckle portion of connector portion 236-1 to lengthen or shorten end portion 253-2 of strap 252. End portion 253-2 of strap 252 may be further pulled or withdrawn from sleeve 250 to bring connector portion 236-1 into connecting engagement with connector portion 236-2. As end portion 253-2 of strap 252 is pulled, end portion 253-1 of strap 252 is moved further into sleeve 250, tightening waist portion 24 about the waist of the person wearing wrap skirt 220.

Figure 15:
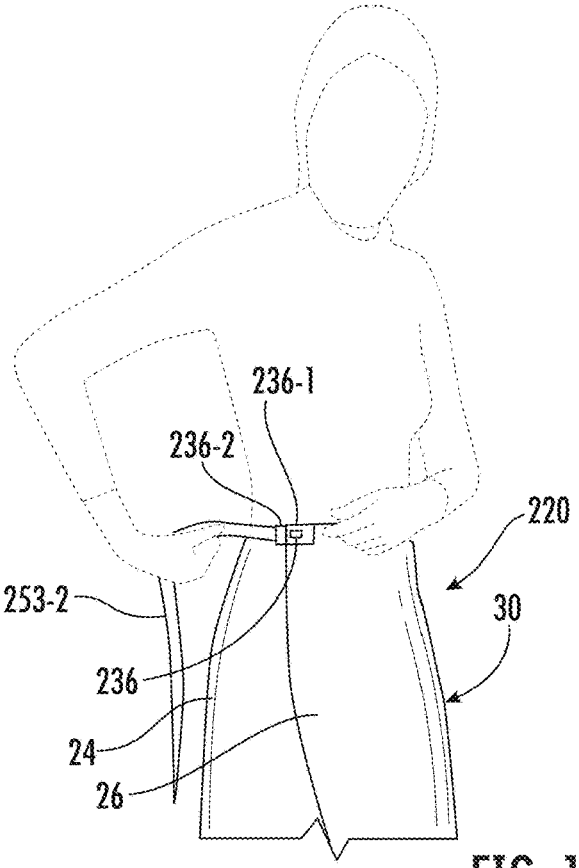
Figure 16:
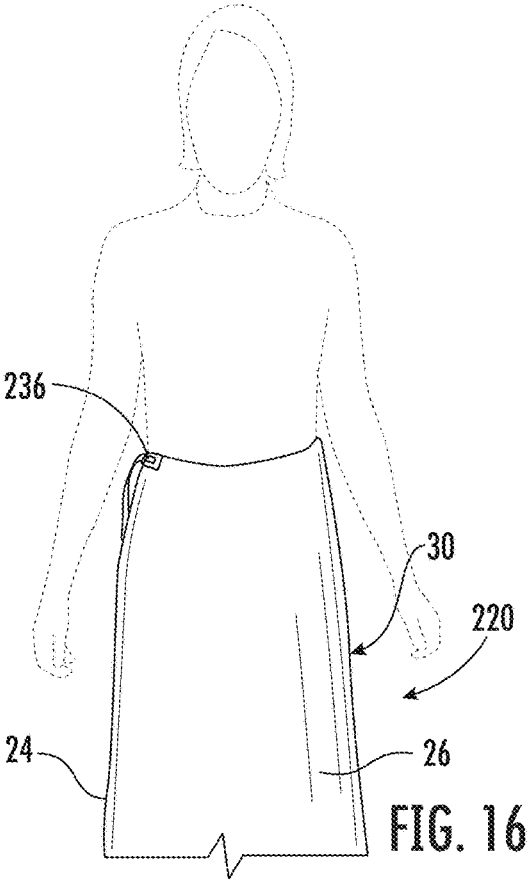

FIG. 15 illustrates connector portions 236-1 and 236-2 interconnected to secure and retain overlapping portion 26 in position over waist portion 24. As further shown by FIG. 15, the person wearing wrap skirt 220 may further pull end portion 253-2 through the buckle of connector portion 236-1 to place overlap portion 26 in greater tension across the front of the person wearing wrap skirt 220. Thereafter, as shown in FIG. 16, wrap skirt 220 is fully assembled. Wrap skirt 220 may be subsequently rotated further about the waist of the person to a desired position.

Figure 17:
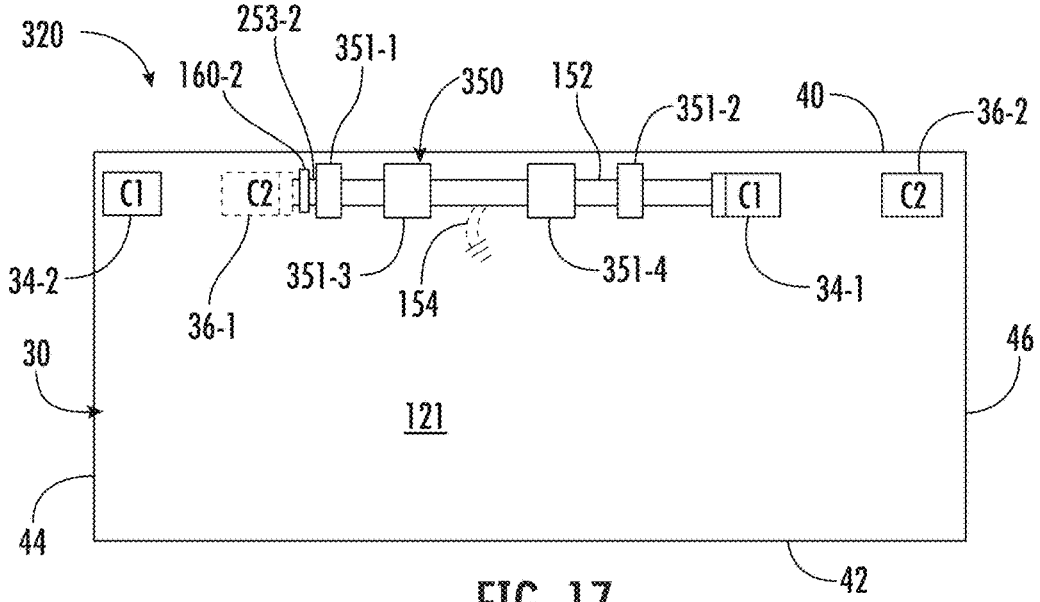
FIG. 17 is a diagram illustrating an inner face of an example wrap skirt.

FIG. 17 illustrates portions of an example wrap skirt 320. Wrap skirt 320 is similar to wrap skirt 120 and 220 described above except that wrap skirt 320 comprises sleeve 350 instead of sleeve 150 or 250. Those remaining components of wrap skirt 320 which correspond to components of wrap skirt 120 are numbered similarly. FIG. 17 illustrates an example of how webbing 152 may be supported and slidably guided by a sleeve formed from multiple individual loops 351-1, 351-2, 351-3 and 351-4 (collectively referred to as loops 351) while leaving portions of webbing 152 exposed.

Loops 351 are formed on the inner face 121 of skirt panel 30. The openings of loops 351 are aligned along the top waist portion 40 of skirt panel 30. As shown by FIG. 17, the individual loops 351 may be differently spaced from one another or uniformly spaced from one another. The different loops 351 may have different lengths relative to one another. Although wrap skirt 320 is illustrated as having four loops 351, in other implementations, wrap skirt 320 may have a greater or fewer of such loops 351.

As further shown by FIG. 17, webbing 152 has an end portion 253-2 which passes through an opening 160-2 in skirt panel 30 such that connector portion 34-1 may be located on the inner face 121 of skirt panel 30 while connector portion 36-1 is located on the exterior face 122 (shown in FIG. 4) of skirt panel 30. In the example illustrated, flexible tether 154 may be stitched, welded, adhered or otherwise affixed to the inner face 121 of skirt panel 30.

Figure 18:
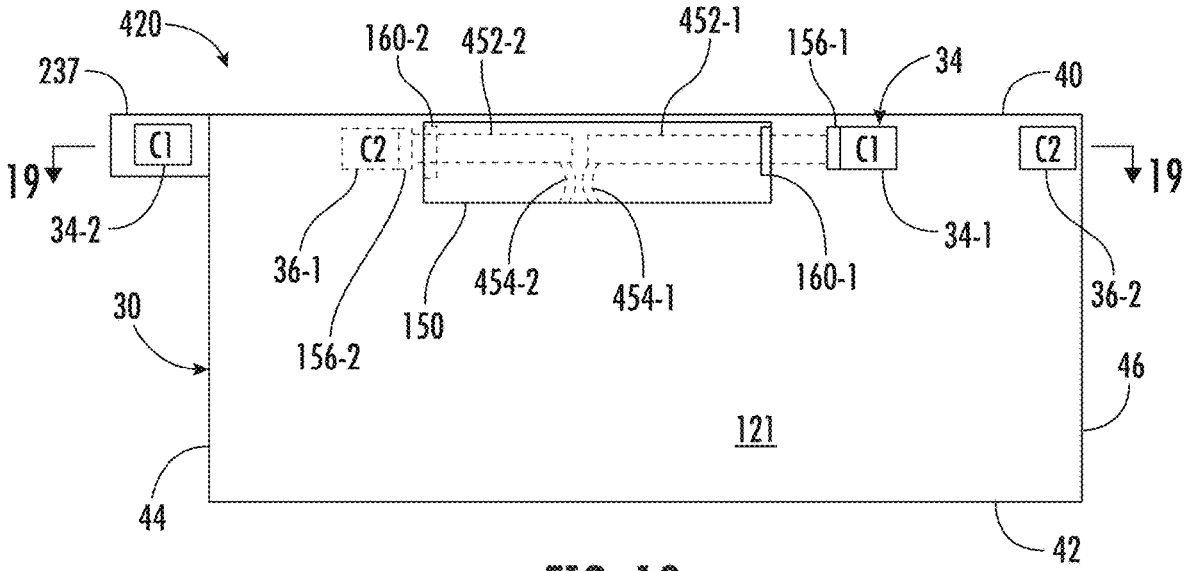
FIG. 18 is a diagram illustrating an interface of an example wrap skirt.
Figure 19:
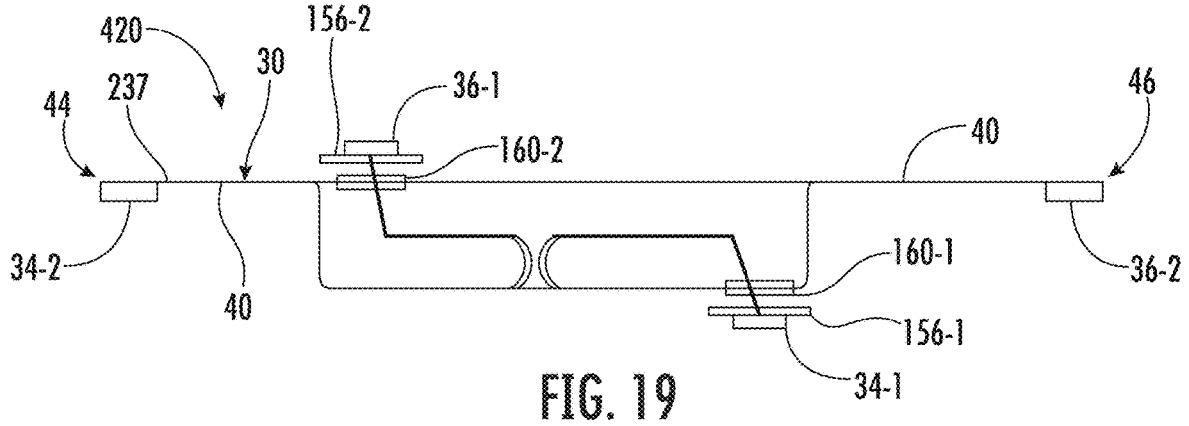
FIG. 19 is a sectional view of the example wrap skirt of FIG. 18 taken along line 19-19

FIGS. 18 and 19 illustrate portions of an example wrap skirt 420. FIGS. 17 and 18 illustrate an example of how connector portions 34-1 and 36-1 may be independently supported by independent webbings. Wrap skirt 420 is similar to wrap skirt 120 and 220 described above except that wrap skirt 320 comprises a pair of webbings 452-1 and 452-2 (collectively referred to as webbing 452) directly or indirectly anchored to skirt panel 30 by flexible tethers 454-1 and 454-2, respectively. Those remaining components of wrap skirt 420 which correspond to components of wrap skirt 120 are numbered similarly. In the example illustrated, connector portion 34-2 is illustrated as being supported by a flexible tab or band 237 (described above with respect to wrap skirt 220). In other implementations, connector portion 34-2 may be supported on the inner face 121 of skirt panel 30 as shown in FIG. 17.

Webbing 452-1 extends from within sleeve 150 through opening 160-1 and supports connector portion 34-1 of connector 34 on the inner face 121 of skirt panel 30. Webbing 452-2 extends from within sleeve 150 through opening 160-2 and supports connector portion 36-1 on the exterior face 122 (shown in FIG. 4) of skirt panel 30. In some implementations, in lieu of being slidably supported by single sleeve 150, each of webbings 452 may be supported and slidably guided by individual and distinct sleeves, a first sleeve for webbing 452-1 and a second sleeve for webbing 452-2. In some implementations, each of webbing 452 may be supported and slidably guided by multiple individual loops such as loops 351 described above with respect to wrap skirt 320.

Because connector portions 34-1 and 36-1 are supported by distinct and independent webbings 452 which are anchored by distinct tethers 454, connector portions 34-1 and 36-1 may be withdrawn from sleeve 150 (or their respective sleeves or loops) by different extents when desired. In some implementations, each of tethers 454 may be elastic or inelastic. In some implementations, each of webbings 452 may be elastic or inelastic.

In some implementations, tethers 454 and/or their associated webbings 452 may have different characteristics relative to one another. For example, tether 454-1 may have a different length as compared tether 454-2 or may have a different extent or degree of elasticity or stretchability as compared to tether 454-2. In some implementations, webbing 452-1 may have a different length as compared to webbing 454-2 or may have a different extent or degree of elasticity or stretchability as compared to webbing 454-2. As a result, the adjustability of the positioning of connectors 34-1 and 36-1 may be different and may be customized to preferences of the person to wear wrap skirt 420.

Although the present disclosure has been described with reference to example implementations, workers skilled in the art will recognize that changes may be made in form and detail without departing from the disclosure. For example, although different example implementations may have been described as including features providing various benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A wrap skirt comprising:

a skirt panel having a top waist portion, a first end and a second end;

a first portion of a first connector coupled to the skirt panel proximate the top waist portion between the first end and the second end;

a second portion of the first connector coupled to the skirt panel proximate the top waist portion proximate the first end;

a first portion of a second connector coupled to the skirt panel proximate the top waist portion between the first end and the second end;

a second portion of the second connector coupled to the skirt panel proximate the top waist portion proximate the second end, wherein the first portion of the first connector mechanically interlocks with the second portion of the first connector to retain the top waist portion about the waistline of the person as an overlapping portion of the skirt panel is wrapped and subsequently retained in place by mechanical interlocking of the first portion of the second connector with the second portion of the second connector;

a sleeve extending along the top waist portion; and a webbing slidably positioned within the sleeve, wherein the first portion of the first connector is carried by a first end portion of the webbing and wherein the second portion of the second connector is carried by a second end portion of the webbing.

2. The wrap skirt of claim 1, wherein the skirt panel has an inner face to face towards the waist and thighs of the person wearing the wrap skirt and an outer face, opposite the inner face, which is to face away from the waist and thighs of the person wearing the wrap skirt, wherein the sleeve has a first opening on the inner face of the skirt panel through which the first portion of the first connector extends and has a second opening on the outer face of the skirt panel through which the second portion of the second connector extends.

3. The wrap skirt of claim 2 further comprising a flexible tether having a first end portion connected to the webbing and a second end portion anchored to the skirt panel.

4. The wrap skirt of claim 1 further comprising a flexible tether having a first end portion connected to the webbing and a second end portion anchored to the skirt panel.

5. The wrap skirt of claim 4, wherein the flexible tether is anchored to the skirt panel within the sleeve.

6. The wrap skirt of claim 1, wherein the second portion of the second connector comprises a buckle slidably and adjustably positioned along the webbing.

7. The wrap skirt of claim 1, wherein the webbing comprises a catch carried by the webbing between the first portion of the first connector and a mouth of the sleeve, the catch being configured to inhibit movement of the first portion of the first connector into the sleeve.

8. The wrap skirt of claim 7, wherein the catch comprises a hook to engage the mouth of the sleeve.

9. The wrap skirt of claim 8, wherein the webbing is folded over itself and secured to itself to form the hook.

10. The wrap skirt of claim 1, wherein the sleeve has a length of at least 4 inches and no greater than 24 inches.

11. The wrap skirt of claim 1, wherein the first connector comprises a snap connector and wherein the second connector comprises a buckle connector.

12. The wrap skirt of claim 1, wherein the first portion of the first connector is slidably positioned along the webbing to slide along the webbing.

13. The wrap skirt of claim 1, wherein the sleeve has a first opening through which the webbing exits the sleeve and a second opening through which the webbing exits the sleeve, wherein the first opening is between the first portion of the first connector and the first portion of the second connector and wherein the second opening is between the first portion of the first connector and the first portion of the second connector.

14. The wrap skirt of claim 1 further comprising a band fixedly secured to and extending from the first end, the band supporting the second portion of the first connector.

15. The wrap skirt of claim 1, wherein the webbing is slidable relative to the sleeve such that pulling one of the first portion of the first connector and the second portion of the second connector further out of the sleeve shortens an extent to which the other of the first portion of the first connector and the second portion of the second connector extends from the sleeve.

16. The wrap skirt of claim 1, wherein both the first end portion and the second end portion of the webbing are exposed and reside between the second portion of the first connector and the first portion of the second connector.

17. A wrap skirt comprising:

a skirt panel having a top waist portion, a first end and a second end;

a first portion of a first connector coupled to the skirt panel proximate the top waist portion between the first end and the second end;

a second portion of the first connector coupled to the skirt panel proximate the top waist portion proximate the first end;

a first portion of a second connector coupled to the skirt panel proximate the top waist portion between the first end and the second end;

a second portion of the second connector coupled to the skirt panel proximate the top waist portion proximate the second end, wherein the first portion of the first connector mechanically interlocks with the second portion of the first connector to retain the top waist portion about the waistline of the person as an overlapping portion of the skirt panel is wrapped and subsequently retained in place by mechanical interlocking of the first portion of the second connector with the second portion of the second connector;

at least one sleeve extending along the top waist portion; and at least one webbing slidably positioned within the at least one sleeve, wherein the first portion of the first connector is carried by a first end portion of the at least one webbing and wherein the second portion of the second connector is carried by a second end portion of the at least one webbing.

* * * * *